United States Patent [19]

Cole

[11] 4,160,415

[45] Jul. 10, 1979

[54] TARGET ACTIVATED PROJECTILE

[75] Inventor: Lewis C. Cole, Chester, N.J.

[73] Assignee: The United States of America as represented by the Secretary of the Army, Washington, D.C.

[21] Appl. No.: 903,330

[22] Filed: May 5, 1978

[51] Int. Cl.[2] ..... F42C 13/04; F42B 13/10

[52] U.S. Cl. ..... 102/214; 102/56 SC; 102/61

[58] Field of Search ..... 102/214, 213, 61, 56 SC, 102/211

[56] References Cited

U.S. PATENT DOCUMENTS

| | | | |
|---|---|---|---|
| 2,925,965 | 2/1960 | Pierce | 102/213 |
| 3,398,916 | 8/1968 | Van Vyve | 102/61 |
| 3,978,797 | 9/1976 | Harrington et al. | 102/214 |

*Primary Examiner*—Charles T. Jordan

*Attorney, Agent, or Firm*—Nathan Edelberg; A. Victor Erkkila; Max Yarmovsky

[57] ABSTRACT

A target activated spin stabilized projectile fired in a sustantially flat trajectory utilizes a pair of diametrically disposed antennae electrically coupled to a 35 gigahertz radiometer to scan a target area. Upon detection of a target within the proximity of the projectile's flight path logic circuitry of the radiometer generates a signal activating one branch of a dual out-of-line ignition system. The selected ignition branch fires a high speed self-forging slug from a target aligned side of a Miznay-Shardin type warhead vertically downward into the "soft" top side of the detected target.

7 Claims, 6 Drawing Figures

FIG 1
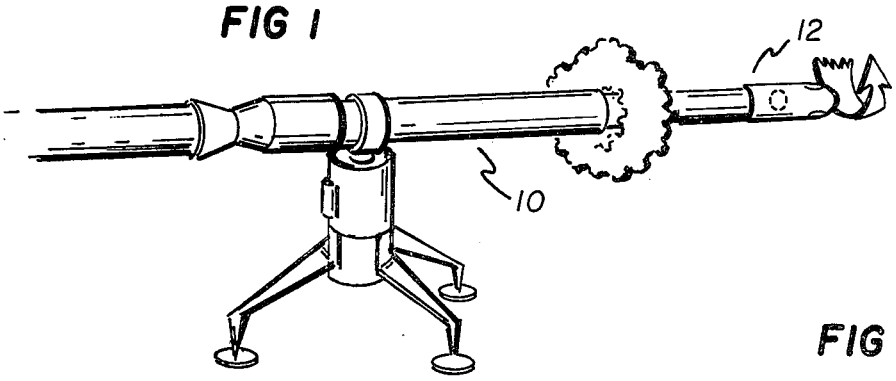
FIG 2
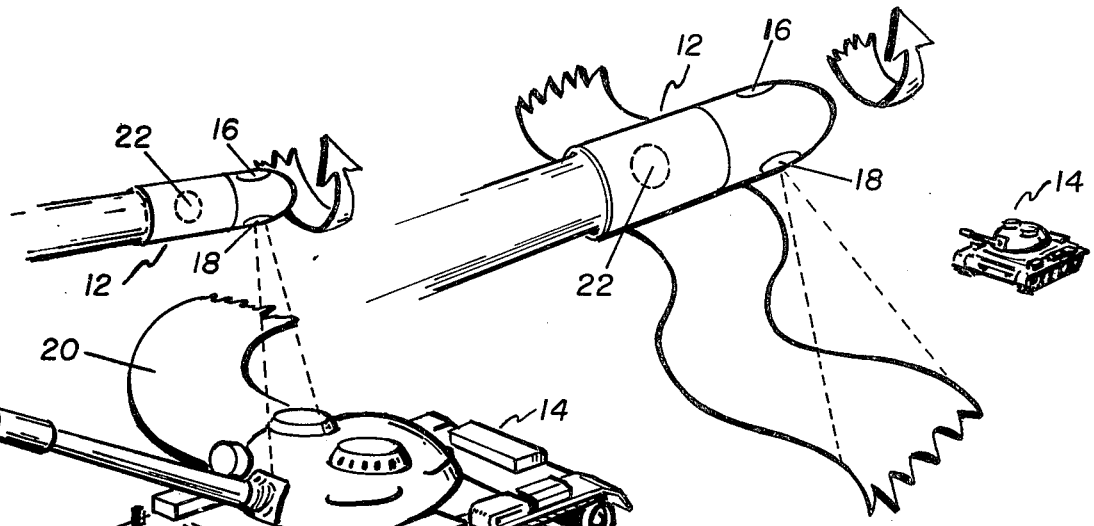
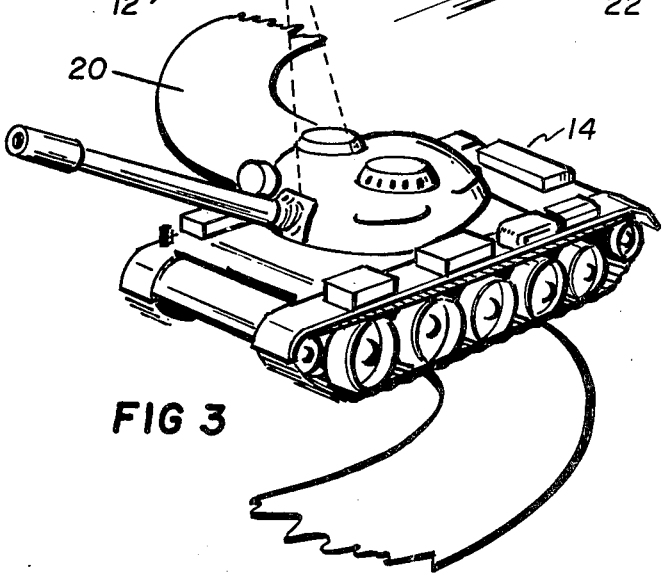
FIG 3
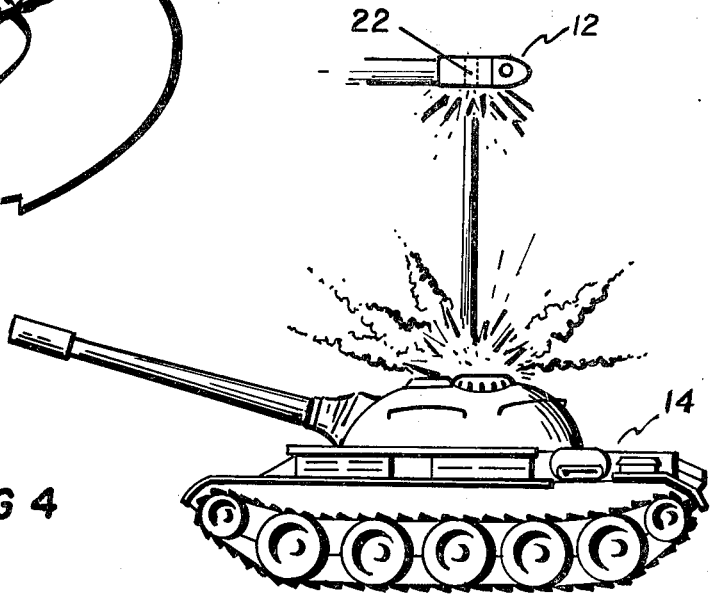
FIG 4

TARGET ACTIVATED PROJECTILE

GOVERNMENTAL INTEREST

The invention described herein may be manufactured, used and licensed by or for the Government for governmental purposes without the payment to me of any royalty thereon.

BACKGROUND OF THE INVENTION

Various means have been used in the prior art to defeat heavily armored vehicles such as tanks or personnel carriers. In the past this was frequently accomplished with direct line-of-sight weapons or wire guided rockets. One of the problems with aforementioned weapons was that the projectile was limited in leathality because it had to be fired into the front, side or rear of the target which normally were the hardest armored areas. These hard armored areas generally included some means for countering direct line-of-fire projectiles.

Another problem with prior art guided systems which require either optical or visual tracking of the target until impact, or illumination of the target by an observer until target impact, is that the probability of hit can be severely reduced by smoke, obscuration and/or loss of line-of-sight. In addition visual tracking and target illumination generally allowed enemy detection and the danger of counterfire and/or countermeasures. A further problem with the prior art devices was that targets could not be successfully attacked in defilade or when obscured from visual observation during flight. Another problem with guided prior art weapon systems was that they are very costly to manufacture because of the complex guidance systems required to obtain pinpoint accuracy.

In addition those projectiles which utilized proximity type fuzes to set off a warhead were frequently ineffective against the sensed target because the warhead fragment cloud was distributed in a 360° pattern rather than being concentrated in a single direction toward the target.

SUMMARY OF THE INVENTION

The present invention relates to a spin stabilized target activated projectile which can be fired from a rifled barrel of a launch weapon with a flat trajectory. The projectile has a scanning radiometer therein for sensing a target as it flies over it and has the capability of initiating a warhead which delivers a high velocity armor penetrating self-forging fragment against the target sensed along the projectile flight path. The target sensing and fragment flight directions are approximately 90° from the longitudinal axis of the projectile. The present invention when fired over an intended target has the capability of impacting and penetrating the top of the lightly armored side of a tank with a high velocity self-forging fragment with the hit probability of a guided missile.

An object of the present invention is to provide a spin stabilized target activated projectile which can be fired from a rifled barrel launch weapon in a flat trajectory, sense a target as it flies over it and initiate a warhead that fires a self-forging fragment which will impact, penetrate and destroy the target being sensed.

Another object of the present invention is to provide a spin stabilized target activated unguided projectile which will sense a tank as it flies over it and have the capability of initiating one end of a dual warhead to deliver a self-forging high velocity slug against the "soft" top side of the target being sensed.

Another object of the present invention is to provide a spin stabilized target activated unguided projectile having passive sensors.

Another object of the present invention is to provide a spin stabilized target activated projectile having sensing antenae therein which transversely scan the projectile's trajectory in a narrow antenna beam.

Another object of the present invention is to provide a spin stabilized target sensing unguided projectile which can defeat targets located in a defilade.

Another object of the present invention is to provide a spin stabilized target sensing unguided projectile which is capable of attacking the vunerable "soft" top side of a tank with a unidirectional self-forging high-density fragment providing the hit probability of a guided projectile or missle.

A further object of the present invention is to provide a spin stabilized target sensing unguided projectile which does not require the launching operator to maintain a sight on the target after the projectile has been fired.

For a better understanding of the present invention, together with other and further objects thereof, reference is made to the following descriptions taken in connection with the accompanying drawings.

BRIEF DESCRIPTION OF THE DRAWINGS

FIG. 1 is an isometric sketch of a spin stabilized projectile being launched from a rifled weapon at a substantially flat trajectory.

FIG. 2 is an isometric sketch of the projectile and the search pattern generated by the scanning radiometer as the projectile approaches a target.

FIG. 3 is an isometric sketch of the scanning projectile detecting the presence of the target.

FIG. 4 is an isometric view of the projectile firing its dual warhead against the top side of the detected target.

Throughout the following description like reference numerals are used to denote like parts of the drawings.

DESCRIPTION OF THE PREFERRED EMBODIMENTS

Figure 5:
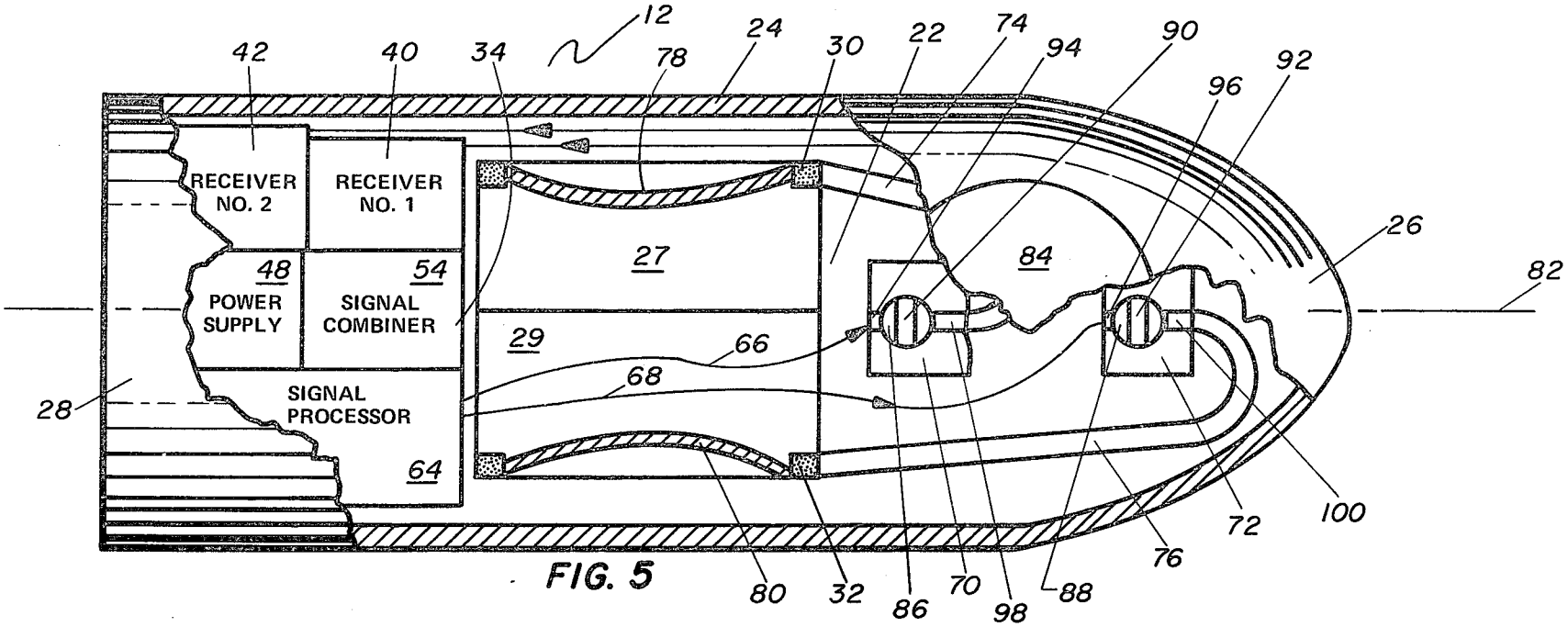
FIG. 5 is a partial cutaway cross-sectional schematic diametrical view of a target activated projectile.

Referring now to FIGS. 1–4 a rifled launch weapon 10 fires a target activated projectile 12 in a spin stabilized flat trajectory at a distant target 14. Projectile 12 has a pair of diametrically disposed transversely positioned antennae 16 and 18 located in the forward end of projectile 12 scanning a continuously advancing ground search pattern 20. The projectile is fired from weapon 10 at a muzzle velocity of approximately 1000 feet per second having a spin of approximately 100 revolutions per second. Projectile 12 has a double ended warhead 22 operatively disposed therein with a dual ignition system capable of initiating either end of the warhead 22 depending upon a signal generated by logic circuitry contained by a radiometer to be discussed in greater detail hereinafter. Double ended warhead 22 is positioned in the projectile 12 so that it will fire in a direction which is transverse to the projectile's flight axis and in a direction in alignment with the top of the sensed target as shown in FIG. 4.

Figure 6:
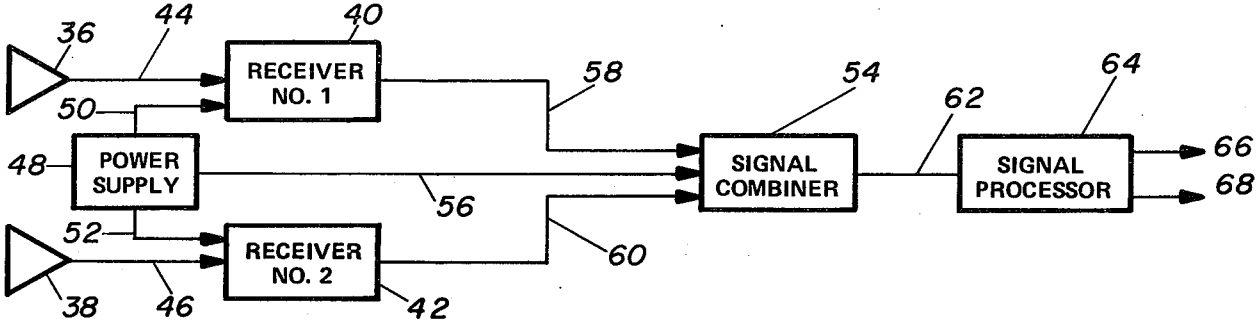
FIG. 6 is a block diagram of radiometer-logic circuitry contained within the target activated projectile.

Referring now to FIGS. 5 and 6, the projectile 12 has a forward ogive shaped end 26 and a cylindrically shaped rear end 28. Warhead 22 is operatively positioned intermediate the forward end 26 and the rear end 28 and includes a first and second Miznay-Shardin type back to back self-forging warhead sections 27 and 29 respectively. The warhead sections 27 and 29 are initiated by peripherially disposed annularly shaped explosive charges 30 and 32 respectively. A radiometer 34 comprises a pair of oppositely disposed antennae 36 and 38 located in forward end 26 and a pair of microwave sensitive receivers 40 and 42, located in rear end 28. Receivers 40 and 42 have inputs, which are electrically coupled to antennae 36 and 38 via electrical conductors 44 and 46 respectively, which amplify the signals detected by the antennae 36 and 38. A setback actuated power supply 48 is electrically coupled to receivers 40 and 42 via electrical conductors 50 and 52 respectively and to signal combiner circuit component 54 via electrical conductor 56. Signal combiner 54 upon receiving two substantially similarly sequenced output signals from the output of receivers 40 and 42, via electrical conductors 58 and 60, will combine these signals and generate an output signal via electrical conductor 62 to signal processor 64. Signal processor 64 contains analog and digital circuitry for performing target detection and discrimination functions. The signal process 64 operates in response to the output of the signal combiner 54 to provide a "fire" signal via either output leads 66 or 68 which in turn initiates first or second safing and arming devices 70 or 72. Safing and arming devices 70 and 72 activate warhead 22 by initiating detonating fuze cords 74 or 76 respectively depending on the signal received from the signal processor 64. A self-forging slug, not shown, having a velocity of approximately 8000 feet/-second is formed from metal concave shaped liners 78 and 80 contained within the Miznay-Shardin type double ended warhead 22. When the projectile is directly over the target, one end of the properly oriented warhead is fired at target 14. The antennae 36 and 38 are oriented to provide two fixed beams with 180° separation in a plane perpendicular to the longitudinal axis 82 and canted 7° in a forward direction so that they can search in a direction that the self-forging fragment will fire. The angle at which the self-forging fragment leaves the projectile is given by the equation $$\text{arc tan } \theta = V_1/V_2$$

where $V_1$ = velocity of the projectile $V_2$ = velocity of the fragment and where $\theta$ = the angle measured from a perpendicular to the longitudinal axis of the projectile and the path of fragment travel.

This angle $\theta$ being the angle the sensors look for the target as that in the actual path the warhead fragment will traverse. The portion of the shell skin in front of the antennae includes a pair of transparent radomes 84, only one of which are shown in FIG. 5, made of such material as reinforced Teflon. The antennae 36 and 38 are capable of operating in the 35 gigahertz frequency region, have a 3 db beam width of 7° or less, a sidelobe level of −25 db maximum, a radio frequency loss equal to or less than 1.5 db, and a voltage standing wave ratio (VSWR) of less than 1.2 to 1.0. The receivers 40 and 42 operate at 35 GHZ, have a noise figure ratio which does not exceed 6 db, a pre-detection bandwidth of 1 GHZ and a post-detection bandwidth of 2.5 MHZ, and an operating range of 20 to 50 meters. Radiometers in the present state of art which can meet the aforementioned requirement are available from such companies as Aerojet Electrosystems Co., Airborne Instrument Laboratories, Minneapolis Honeywell and the Singer Co.

In operation power supply 48 is activated by the force of setback when projectile 12 is launched from weapon 10. The projectile 12 is changed from the "safe" condition shown in FIG. 5 to an "armed" condition when rotor members 86 and 88 are rotated 90° causing detonators 90 and 92 to change from an out-of-line position to an in-line-position wherein electrical igniting squibs 94 and 96 and explosive leads 98 and 100 are aligned with detonators 90 and 92 respectively to permit initiation of fuze cords 74 and 76. When antenna 36 or antenna 38 detects a target, the logic circuitry of radiometer 34 is set up such that when the same target is detected by the opposite antenna, signal processor 64 will accept the signal to be processed. The linear distance traveled by the projectile 12 during this interval of time will be approximately 5 feet when the projectile is spinning at a rate of 100 revolutions per second. When for example antenna 36 detects the target 14 first and then antenna 38 sees the same target one half a revolution later the signal processor 64, one quarter of turn later, will issue a fire signal through electrical conductor 66 which will activate electrical squib 94 and initiate detonator 90 which in turn initiates detonating fuze cord 74 through explosive lead 98. Fuze cord 74 will in turn initiate the Miznay-Shardin first warhead section 27 through the peripheral annular explosive charge 30 causing a self-forging slug formed from a first-metal concave shaped liner 80 to travel at high speed, 8000 feet per second, toward the target directly underneath projectile 12, as shown in FIG. 4. In a similar fashion if antenna 38 detects the target 14 first and antenna 36 confirms the target one half a revolution later, the radiometer 34 one quarter turn later will issue a fire signal through electrical conductor 68 which initiates electrical squib 96, detonator 92 and detonator fuze 76 through explosive lead 100 and in turn will cause second warhead section 29 to form a self-forging slug from second concave shaped metal liner 78 which would travel the target 14.

The foregoing disclosure and drawings are merely illustrative of the principles of this invention and are not to be interpreted in a limiting sense. I wish it to be understood that I do not desire to be limited to the exact details of construction shown and described for obvious modifications will occur to a person skilled in the art.

Having thus fully described the invention, what is claimed as new and desired to be secured by Letters Patent of the United States is:

1. A target activated spin stabilized projectile fired in a substantially flat trajectory against metal armored ground targets comprises:

a tubularly shaped housing having an ogive shaped forward end and a cylindrically shaped rear end;

double ended warhead means, transversely operatively disposed intermediate said forward end and said rear end of said housing, for firing a self-forging armor piercing fragment from one end of said double ended warhead means at said armored target in a direction normal to said flat trajectory of said projectile when said projectile passes directly over said target;

set back actuated radiometer means for detecting the presence of said target along a ground search pattern beneath said flat trajectory of said projectile, and for initiating a firing signal to fire said double ended warhead means in response to radiation detection of said armored target when said armored target is aligned with one end of said double ended warhead means; and set back activated detonator means for safing and arming said projectile during launch and for initiating said warhead means upon receipt of said firing signal from said radiometer means.

2. A target activated spin stabilized projectile as recited in claim 1 wherein said double ended warhead means comprises:

a first section of a Miznay-Shardin warhead charge having a first operatively disposed annular explosive charge located on one end thereof, said explosive charge positioned in peripheral abutment with a first concave shaped metal liner; and a second section of said Miznay-Shardin warhead charge diametrically disposed opposite from said first section of said warhead charge, said second section having a second annular explosive charge located on one end thereof and in peripheral abutment with a second concave shaped metal liner, said first and second sections of said Miznay-Shardin warhead firing in a direction normal to the longitudinal axis of said tubularly shaped housing.

3. A target activated spin stabilized projectile as recited in claims 2 wherein said set back activated radiometer means comprises:

a pair of diametrically disposed antennae operatively positioned in said front end of said housing of said projectile, said antennae being located rotationally 90° from said double ended warhead means, for detecting electromagnetic radiations from a metal armored target;

a pair of microwave sensitive receivers electrically coupled to the output of said pair of antennae for amplifying microwave signals of approximately 35 gigahertz;

signal combiner circuit means having an input electrically coupled to the outputs of said pair of receivers for generating an output signal upon receiving two substantially similar signatured sequenced output pulses from said pair of receivers; and signal processor means having an input electrically coupled to the output of said signal combiner circuit means for generating a first and second fire signal for initiating said setback activated detonator means.

4. A target activated spin stabilized projectile as recited in claim 3 wherein said setback activated detonator means comprises:

a first safing and arming means electrically coupled to a first output of said signal processor means, having a first set back operated rotor member operatively positioned therein for holding a first detonator member in an out-of-line "safe" position intermediated a first operatively disposed electrical igniting squib and a first explosive lead prior to projectile launch and for positioning said first detonator in an in-line "armed" position after said projectile is launched;

a second safing and arming means electrically coupled to a second output of said signal processor means, having a second setback operated rotor member operatively positioned therein for holding a second detonator member in an out-of-line "safe" position intermediate a second operatively disposed electrical igniting squib and a second explosive lead prior to projectile launch and for positioning said second detonator in an in-line "armed" position after said projectile is launched; and detonating fuze cord means for explosively igniting said first or second annular explosive charges of said double ended warhead means in response to an initiation of said first explosive lead or said second explosive lead.

5. A target activated spin stabilized projectile as recited in claim 4 wherein said pair of antennae include a pair of microwave transparent radomes operatively located in said forward end of said housing.

6. A target activated spin stabilized projectile as recited in claim 5 wherein said pair of antennea include means for operating in a 35 gigahertz region, having a 3 db beamwidth of 7° or less, a sidelobe level of −25 db maximum, a radio frequency loss equal to or less than 1.5 db, and a voltage standing wave ratio of less than 1.2 to 1.0.

7. A target activated spin stabilized projectile as recited in claim 5 wherein said pair of microwave sensitive receivers includes means for a predetection bandwidth of 1 gigahertz, a post-detection bandwidth of 2.5 megahertz, and an operating range of 20 to 50 meters.

* * * * *